US007086538B2

(12) United States Patent
Stravitz

(10) Patent No.: US 7,086,538 B2
(45) Date of Patent: Aug. 8, 2006

(54) MULTI-SECTION RETAINING/SORTING/BROWSING APPARATUS

(76) Inventor: David M. Stravitz, 16 Park Ave. - Suite 14A, New York, NY (US) 10016

( * ) Notice: Subject to any disclaimer, the term of this patent is extended or adjusted under 35 U.S.C. 154(b) by 274 days.

(21) Appl. No.: 10/702,205

(22) Filed: Nov. 4, 2003

(65) Prior Publication Data

US 2005/0092698 A1 May 5, 2005

(51) Int. Cl.
*B42F 17/00* (2006.01)

(52) U.S. Cl. ..... 211/11; 211/126.13; 211/169

(58) Field of Classification Search ..... 211/10, 211/11, 50, 53, 58, 184, 169, 171, 99, 169.1, 211/165, 126.13; 108/60, 61; 206/371
See application file for complete search history.

(56) References Cited

U.S. PATENT DOCUMENTS

| | | | | | |
|---|---|---|---|---|---|
| 744,350 | A | | 11/1903 | Jewell | |
| 750,350 | A | | 1/1904 | Denson | |
| 807,084 | A | | 12/1905 | Muller | |
| 1,106,265 | A | * | 8/1914 | Whittle | 40/383 |
| 1,119,925 | A | * | 12/1914 | Chatham | 40/400 |
| 1,440,491 | A | * | 1/1923 | Proudfit | 211/11 |
| 1,736,574 | A | * | 11/1929 | Binks | 211/11 |
| 1,764,128 | A | | 6/1930 | Straubel | |
| 2,047,097 | A | * | 7/1936 | Dunbar | 211/169.1 |
| D148,076 | S | | 12/1947 | Kessing, Jr. | |
| 2,459,385 | A | * | 1/1949 | Martin | 211/51 |
| 2,581,730 | A | * | 1/1952 | Talmage et al. | 211/11 |
| 3,358,692 | A | | 12/1967 | Proulx | |
| 3,446,360 | A | * | 5/1969 | Gutierrez | 211/40 |
| 3,554,381 | A | * | 1/1971 | Guest et al. | 211/11 |
| D231,137 | S | | 4/1974 | Juhlin | |
| 3,812,975 | A | * | 5/1974 | Gutierrez | 211/40 |
| 3,869,045 | A | * | 3/1975 | Lear | 211/11 |
| 3,966,050 | A | * | 6/1976 | Dahl | 211/10 |
| 4,084,699 | A | * | 4/1978 | Koepke | 211/11 |
| 4,426,007 | A | * | 1/1984 | Beleckis et al. | 211/40 |
| 4,512,480 | A | | 4/1985 | Evenson | |
| 4,629,067 | A | | 12/1986 | Pavlik et al. | |
| 5,215,198 | A | | 6/1993 | Sutton | |

(Continued)

OTHER PUBLICATIONS

Related U.S. Appl. No. 29/191,270, filed Oct. 3, 2003; Inventor: David M. Stravitz; Title: Browser/Sorter.

(Continued)

*Primary Examiner*—Jennifer E. Novosad
(74) *Attorney, Agent, or Firm*—Frishauf, Holtz, Goodman & Chick, P.C.

(57) ABSTRACT

Multi-section retaining/sorting/browsing apparatus including a base defining at least one cavity and including a first plurality of parallel slots opening thereto and dividers arranged in connection with the base to define an object-retaining section between adjacent dividers. Each divider has an anchor portion arranged in the cavity and an object support portion coupled to the anchor portion and extending through a respective slot to provide a support for retaining objects. To retain the dividers in connection with the base, the anchor portion of each divider has a width larger than a width of the respective slot. The anchor portion is rotatable in the cavity to enable the divider to be flipped forward and backward in a longitudinal direction. When file folders or other objects are retained in the object-retaining sections, it becomes possible to sort papers, documents or files in the sections and to browse through the contents of a file folder without removing them from the apparatus.

23 Claims, 6 Drawing Sheets

U.S. PATENT DOCUMENTS

| | | | | |
|---|---|---|---|---|
| D353,158 | S | 12/1994 | Evenson | |
| D388,121 | S | 12/1997 | Gomez | |
| 6,065,610 | A * | 5/2000 | Elmore | 211/10 |
| D432,578 | S | 10/2000 | Stravitz | |
| D440,809 | S | 4/2001 | Hunt | |
| 6,227,384 | B1 | 5/2001 | Saylor et al. | |
| D500,803 | S | 1/2005 | Stravitz | |
| D502,220 | S | 2/2005 | Stravitz | |
| D504,702 | S | 5/2005 | Stravitz | |

OTHER PUBLICATIONS

Related U.S. Appl. No. 29/205,947, filed May. 20, 2004; Inventor: David M. Stravitz; Title: Browser/Sorter.

Related U.S. Appl. No. 29/213,842, filed Sep. 23, 2004; Inventor: David Stravitz; Title: Browser/Sorter.

* cited by examiner

MULTI-SECTION RETAINING/SORTING/BROWSING APPARATUS

FIELD OF THE INVENTION

The present invention relates to an apparatus which defines a plurality of retaining sections each of which is capable of receiving various objects and which enables easy sorting of objects as well as browsing of the objects received in the retaining sections.

BACKGROUND OF THE INVENTION

In an office setting, a common situation arises in which papers or documents must be retained and/or sorted. For example, it might be required to create ten different booklets with each booklet having twenty sequentially numbered pages. If the twenty pages are printed one at a time in batches of ten (one for each booklet), then they will have to be sorted with one page being allotted to each booklet.

A multi-section retaining/sorting/browsing apparatus is often used for this purpose and includes a plurality of dividers which define object-retaining sections therebetween into which the pages can be placed sequentially. That is, first the page numbered 1 is placed in each section, then the page numbered 2 is placed behind page number 1 in each section, and so on until ten complete booklets are created. When placing a page in each section, the dividers may be flipped to expose that section and after the page is placed in that section, a divider may be flipped to expose an adjacent section. The sorting process continues in this manner by flipping the dividers and inserting pages into each exposed section. Alternatively, sorting can be done in reverse, starting with the last page. Using this technique, flipping of the dividers may be avoided.

Such multi-section retaining/sorting/browsing apparatus are also used to hold file folders to enable papers to be stored and/or sorted into the file folders. In this case, a file folder can be retained in each section and opened one at a time by flipping the dividers (without removing the file folder) and one or more pages or documents may be placed into each file folder as it is opened.

The same apparatus also enables browsing through the file folders retained in the apparatus. For example, by flipping the dividers to expose the file folders in each section, it is possible to view the contents of each file folder without removing the file folders from the apparatus. By placing the file folders in the sections defined by the apparatus, it is not required to remove the file folders to open each one but rather, the file folders can be continually retained in the sections in the apparatus and by flipping the dividers, each file folder can be opened and browsing of the contents thereof is possible.

A problem with the conventional multi-section retaining/sorting/browsing apparatus of this type is that not all of the known devices allow for a file folder in a particular section to be opened without requiring the exertion of pressure to keep the dividers in place and that section exposed.

A multi-section retaining/sorting/browsing apparatus is often also used to display small objects for sale, wherein it is desired to ease the purchaser's ability to browse through the objects. In particular in the sale of multi-media objects, such as CDs, DVDs, records and computer software, it is desirable to enable a purchaser to relatively easily and quickly flip through the objects to see whether any are of interest for possible purchase. To this end, by providing a retaining/sorting/browsing apparatus including a plurality of dividers which define object-retaining sections therebetween into which the multi-media objects are placed, the purchaser can easily flip the dividers, or the objects depending on which is larger, forward or backward to view the objects in each section. If the objects are larger and thus flipped, then the dividers are flipped upon flipping of the objects.

Unfortunately, retaining/sorting/browsing devices are not always designed so that easy flipping is provided in combination with the ability to allow the user or purchaser to expose an object or objects in one or more of the object-retaining sections without exerting pressure to keep the dividers in position so that the desired section is exposed.

OBJECTS AND SUMMARY OF THE INVENTION

Accordingly, it is an object of the present invention to provide a new and improved multi-section retaining/sorting/browsing apparatus.

It is another object of the present invention to provide a new and improved multi-section retaining/sorting/browsing apparatus including a plurality of object-retaining sections and which is designed to facilitate easy sorting of objects into each section.

It is still another object of the present invention to provide a new and improved multi-section retaining/sorting/browsing apparatus including a plurality of object-retaining sections and which enables exposure and viewing of an object or objects such as file folders in one or more of the object-retaining sections preferably without exerting pressure to keep the dividers in place and that section exposed.

It is yet another of the present invention to provide a new and improved multi-section retaining/sorting/browsing apparatus which is easy to assemble.

In order to achieve these objects and others, a multi-section retaining/sorting/browsing apparatus in accordance with the invention includes a base defining at least one cavity and including at least one set of parallel slots opening thereto and dividers arranged in connection with the base to define an object-retaining section between adjacent dividers. Each divider has an anchor portion arranged in the cavity and an object support portion coupled to the anchor portion and extending through a respective slot to provide a support for retaining objects. The anchor portion is rotatable in the cavity to enable the divider to be flipped forward and backward in a longitudinal direction of the apparatus.

To retain the dividers in connection with the base, the anchor portion of each divider generally has a width larger than a width of the respective slots. To this end, the anchor portion may be provided with a uniform width, e.g., substantially cylindrical with a uniform diameter, while the slot may be provided with a uniform width. Other mechanisms for ensuring retention of the dividers in connection with the base are also possible and some are discussed below.

With such an apparatus, it becomes possible to place file folders in each section to enable sorting of papers or documents into the file folders in the sections and browse through the file folders without removing them from the apparatus.

The construction of the slots in the base with a smaller width than the width of the anchor portions of the dividers is generally sufficient to retain the dividers in connection with the base, i.e., prevent removal of the dividers from the base. However, various modifications of the base and the dividers are possible to ensure that the dividers are retained in connection with and rotatable relative to the base. For example, in one embodiment, at least one end of the anchor portion includes a projection engagable with a recess in an inner wall of the cavity. The projection enters into the recess upon installation of the divider in connection with the base and this engagement assists in preventing removal of the divider from the base. In the alternative, a recess can be provided in the anchor portion and a complementary projection formed in the base.

In another embodiment, the anchor portion of the dividers is provided with a larger transverse length that the transverse length of the slots. More specifically, the transverse end of each anchor portion includes a projection which extends beyond the transverse end of the respective slot. To accommodate the elongated anchor portions, the transverse length of the cavity is larger than the transverse length of the slots, i.e., each slot has a first transverse end spaced inward from an adjacent end of the cavity and a second transverse end spaced inward from an adjacent end of the cavity.

Each slot may be defined by angled surfaces of the top wall of the base which limit flipping of the dividers by virtue of contact between the dividers and the angled surfaces.

The base may be formed from a first, cover member defining the top wall and a second member defining the bottom wall. The cover member includes an opening in a lower surface into which the second member is placed. To assemble the apparatus, prior to insertion of the lower member into the opening of the cover member, the object support portion of each divider is placed through the slots from below and thereafter, the lower member is inserted into the opening and fixed to the cover member. Since the anchor portion has a larger width than the width of the slots, the dividers cannot be removed from the base once the lower member is fixed to the cover member.

Although the base may be constructed from two separate members as described above wherein the dividers are inserted through the slots from below, in this case, it is possible to form the base as a unitary member with individual cavities or a common cavity and to insert the anchor portion of the dividers into the cavity or respective cavity by forming the anchor portion from a material which provides a small degree of resiliency. In this manner, the anchor portion can be pressed through the slot into the cavity.

BRIEF DESCRIPTION OF THE DRAWINGS

The invention, together with further objects and advantages thereof, may best be understood by reference to the following description taken in conjunction with the accompanying drawings, wherein like reference numerals identify like elements.

DETAILED DESCRIPTION OF THE INVENTION

Figure 1:
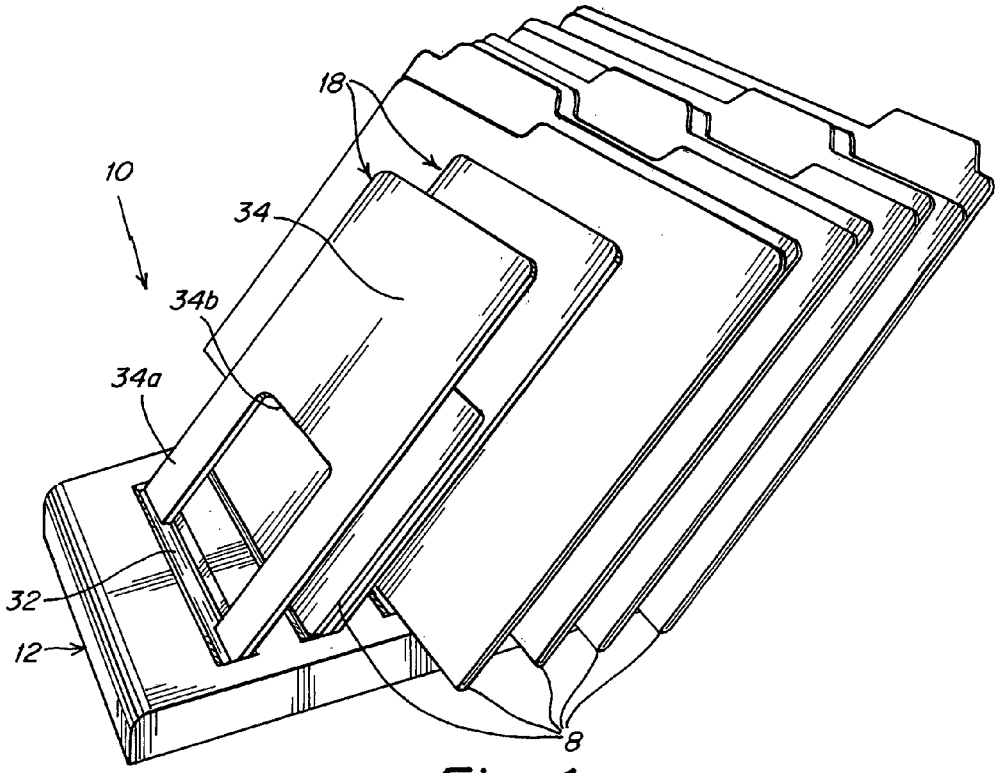
FIG. 1 is a perspective view of a multi-section retaining/sorting/browsing apparatus in accordance with the invention in use while retaining file folders and a media storage package.

Referring to the accompanying drawings wherein like reference numerals refer to the same or similar elements, a multi-section retaining/sorting/browsing apparatus in accordance with the invention is designated generally as 10 and comprises a base 12 defining one or more cavities 14 (see FIG. 4A) and including a plurality of parallel slots 16. The apparatus 10 also includes dividers 18 arranged in connection with the slots 16 in the base 12 and extending at least partially into the cavity(ies) 14. The dividers 18 define object-retaining sections 20 therebetween, i.e., one object-retaining section 20 is defined between each adjacent pair of dividers 18 (see FIG. 2). Objects 8, such as file folders or the like, are shown in the object-retaining sections 20.

To establish a convention for the following description and without limiting the invention, in the embodiment shown in FIGS. 1–6 and 8, all of the slots 16 extends in a transverse direction of the base 12 and the slots 16 are therefore arranged alongside and substantially parallel to one another in a longitudinal direction of the base 12.

In some embodiments, a single cavity 14 is provided in the base 12, in which case, all of the slots 16 communicate with the single cavity 14 and a portion of each divider 18 is situated in the single cavity 14. On the other hand, if a plurality of cavities 14 are provided in the base 12 (see FIG. 4B), each slot 16 can be arranged to communicate with a respective cavity 14, i.e., there are an equal number of cavities 14 and slots 16. Nevertheless, it is also possible to have multiple cavities 14 with each cavity 14 communicating with a plurality of slots 16.

All of the slots 16 may have the same size for receiving dividers 18 having the same length as shown in FIG. 1. In this case, a single cavity 14 can be formed in the base 12. However, if it is desired to provide two or more sets of dividers with each set having a different length, then two or more cavities can be formed in the base, with each cavity having a length in a transverse direction designed to accommodate a respective set of dividers.

The base 12 may be formed from two members, an upper member 22 defining a top wall 24 of the cavity or cavities 14 and a lower member 26 (see FIG. 3A) defining a bottom wall 28 of the cavity or cavities 14. The upper member 22 may include an opening in a bottom surface 22*a* into which the lower member 26 is positioned and then either permanently or removably attached to the upper member 22. A permanent form of connection for the upper and lower members 22, 26 may be provided by an adhesive such as glue or fastener members such as nails, screws and the like. A removable form of connection for the upper and lower members 22, 26 may be provided by a releasable locking member shown in FIG. 5, e.g., a projection 40 formed on the lower member 26 which engages with a recess 42 formed on the upper member 22" whereby the portion of the upper member 22" including the recess 42 is slightly flexible to enable outward flexing thereof and removal of the lower member 26" from engagement with the upper member 22".

Figure 3A:
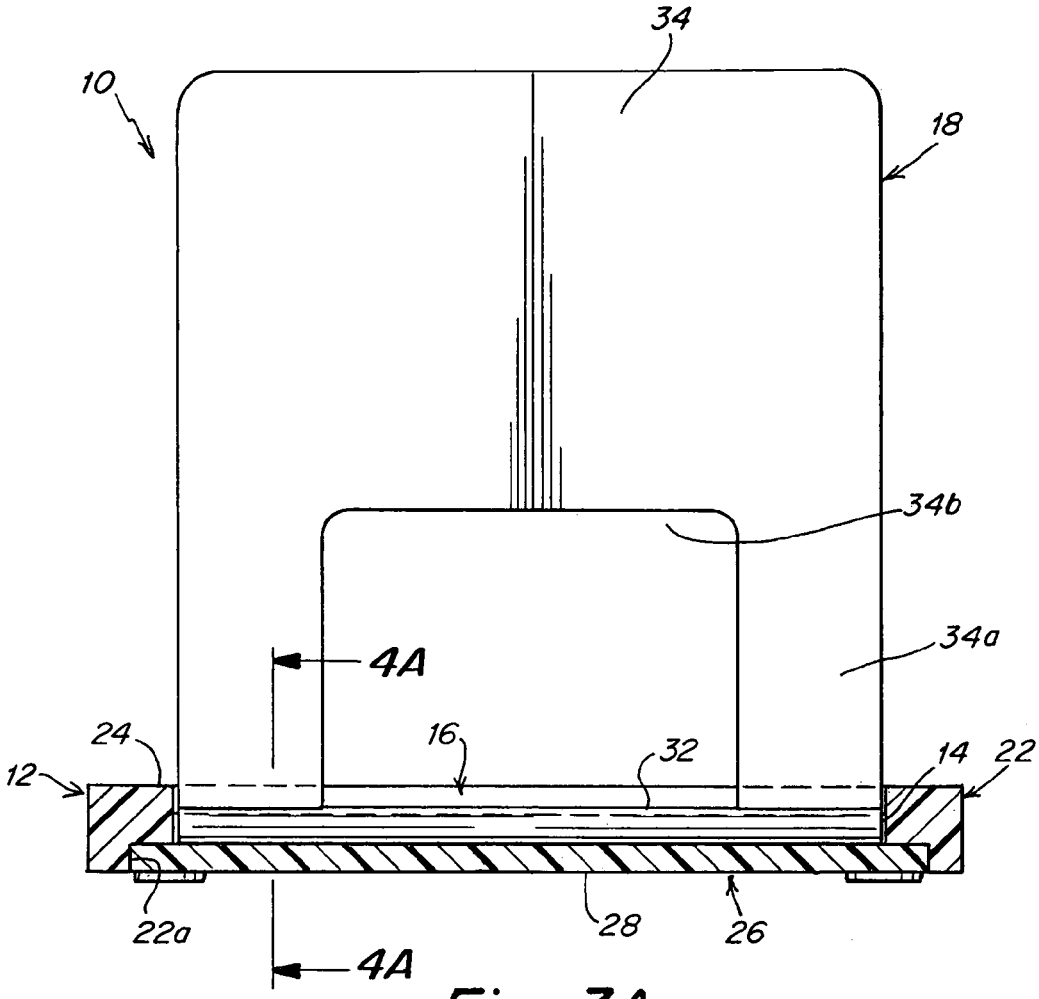
FIG. 3A is a cross-sectional view taken along the line 3—3 in FIG. 2 of the multi-section retaining/sorting/browsing apparatus in accordance with the invention shown in FIG. 1.
Figure 4A:
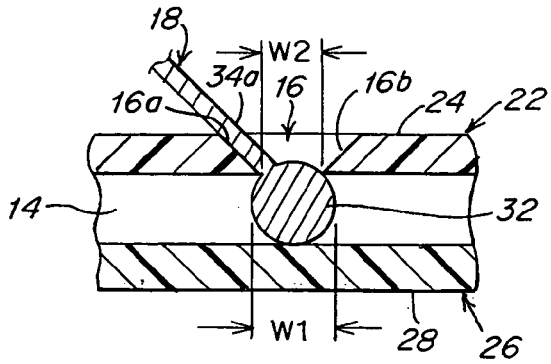
FIG. 4A is a cross-sectional view taken along the line 4A—4A in FIG. 3A of the multi-section retaining/sorting/browsing apparatus in accordance with the invention shown in FIG. 1.

Referring now to FIGS. 3A and 4A, in a first embodiment of the invention, a single cavity 14 is provided and the plurality of slots 16 all communicate with this cavity 14. The slots 16 are arranged in the top wall 24 of the upper member 12 and have substantially the same transverse length as the cavity 14.

Figure 2:
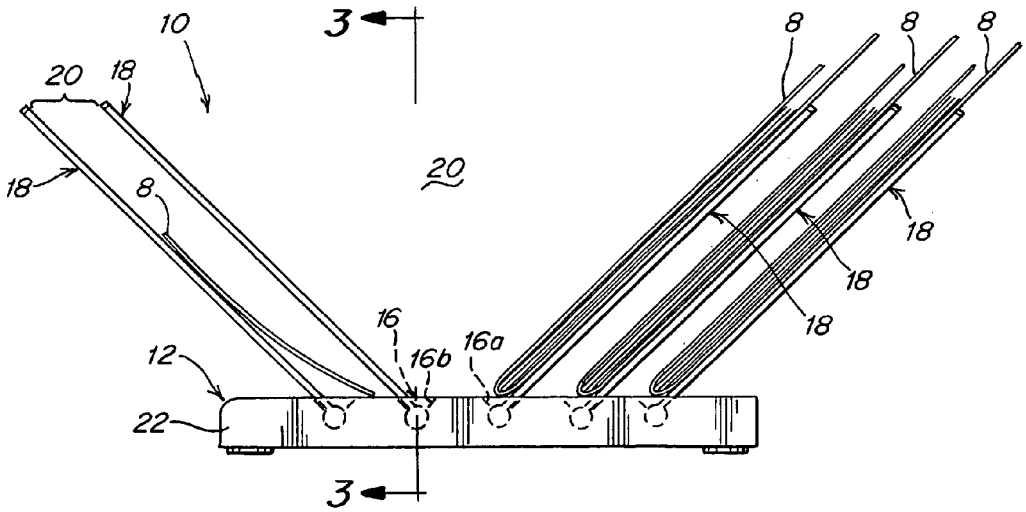
FIG. 2 is a side view of the multi-section retaining/sorting/browsing apparatus shown in FIG. 1

Each divider 18 has an anchor portion 32 arranged in the cavity 14 and an object support portion 34 coupled to the anchor portion 32 and extending through a respective slot 16 to provide a support for retaining the objects 8 (see FIG. 2). To retain the dividers 18 in the base 12, the anchor portion 32 has a larger width W1 (the diameter when the anchor portion is cylindrical) than the smallest width W2 of the slot 16 (W1>W2) so that the anchor portion 32 cannot pass through the slot 16 once placed in the cavity 14 during assembly of the apparatus 10 (described below).

To enable a limited amount of flipping of the dividers 18 during use of the apparatus 10, each slot 16 is preferably defined by downwardly angled surfaces 16*a*, 16*b* of the top wall 24 of the base 12. As such, a smaller opening is formed in a lower surface of the top wall 24 than in an upper surface of the top wall 24 for each slot 16 (see FIG. 4A). The dividers 18 are thus rotatable over an angular range defined by the angled surfaces 16*a*, 16*b*.

The anchor portion 32 is rotatable in the cavity 14 to enable the divider 18 to be flipped forward and backward in a longitudinal direction (see FIG. 2) wherein two dividers 18 are shown having been flipped forward whereas three dividers 18 are shown having been flipped backward in which case, an object-retaining section 20 between the second and third dividers 18 is exposed). When flipped forward, the divider 18 will rest against the rearward facing angled surface 16*a* and when flipped rearward, the divider 18 will rest against the forward facing angled surface 16*b*.

To enable passage of the object support portion 34 through the respective slot 16, a part 34*a* of the object support portion 34 has a length in the transverse direction equal to or less than the length of the respective slot 16. The object support portions 34 may be substantially planar and directly connected to the anchor portions 32. Also, the object support portions 34 may be provided with different forms or shapes as desired, e.g., with a recess 34*b* as shown, and from different materials (i.e., metal, plastics, wood, etc).

To assemble the apparatus 10, the upper and lower members 22, 26 and dividers 18 are first constructed and the dividers 18 are inserted through the slots 16 by inserting the object support portions 34 of the dividers 18 through the slots 16 until the anchor portions 32 come into contact with the lower surface of the top wall 24 of the upper member 22. Then, the lower member 26 is inserted into the opening 22*a* in the upper member 22 and attached to the upper member 22. The apparatus is thus ready for use for retaining objects, for enabling sorting of objects such as papers and documents, and for enabling browsing of objects such as file folders.

Figure 3B:
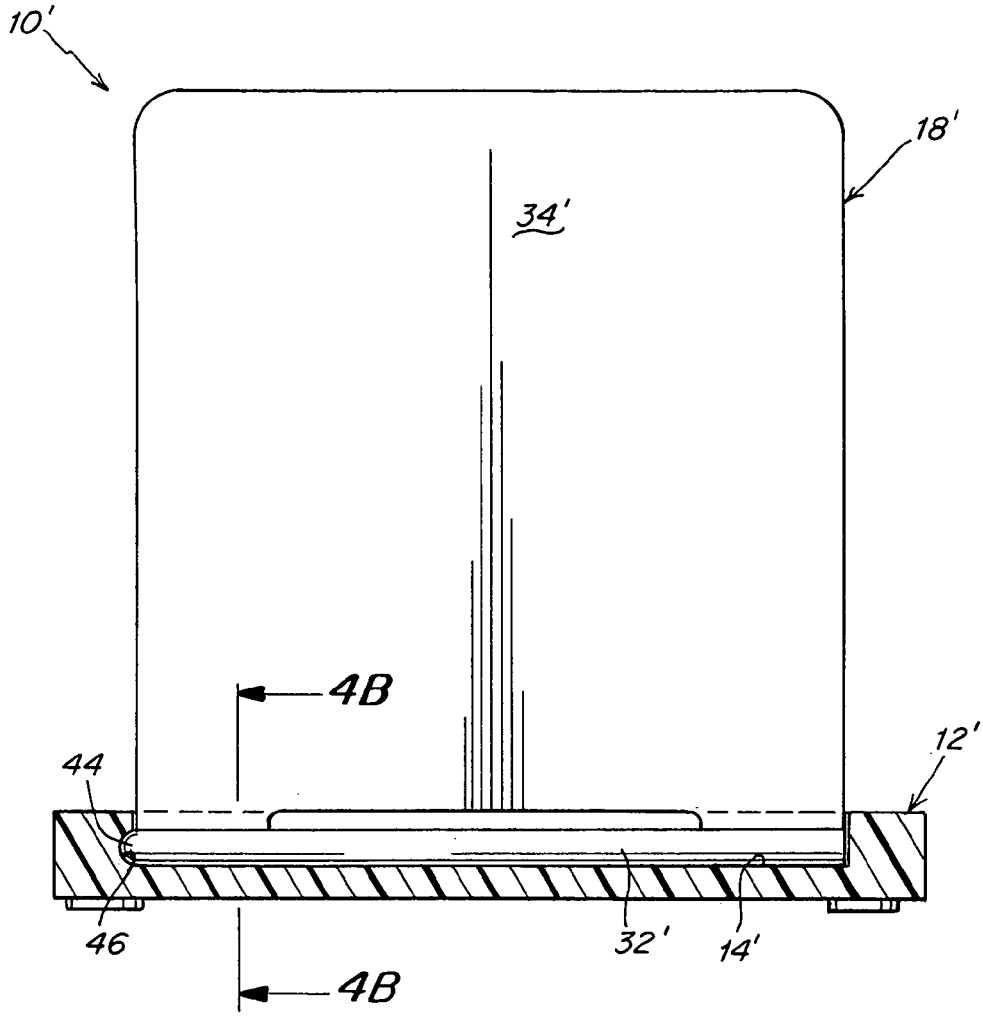
FIG. 3B is a cross-sectional view taken along the line 3—3 in FIG. 2 of another embodiment of a multi-section retaining/sorting/browsing apparatus in accordance with the invention.
Figure 4B:
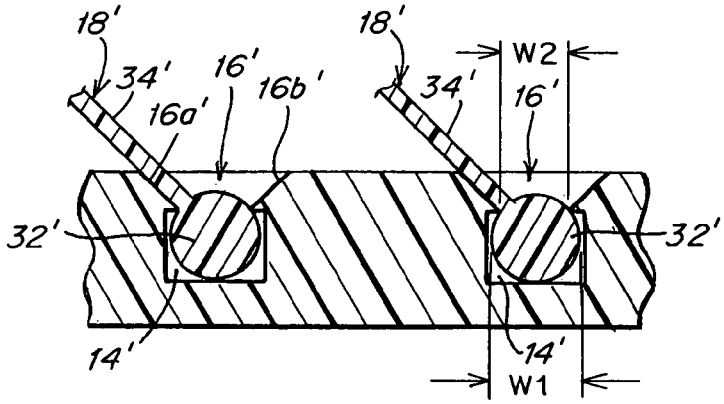
FIG. 4B is a cross-sectional view taken along the line 4B—4B in FIG. 3B.

Referring now to FIGS. 3B and 4B, another embodiment of the multi-section retaining/sorting/browsing apparatus in accordance with the invention (designated 10') includes a base 12' which has a unitary construction formed with a plurality of cavities 14' and parallel slots 16', each slot 16' communicating with a respective one of the cavities 14' (although it is also possible to form a single cavity in the base 12' communicating with a plurality of or all of the slots 16' as described above).

Dividers 18' are retained in the cavity 14' by virtue of the anchor portion 32' having a width W1 (the diameter of the anchor portion since the anchor portion 32 is cylindrical) larger than the width W2 of the slots 16' (see FIG. 4B). As such, the anchor portion 321 cannot pass upwardly through the slot 16'.

Since the base 12' has a unitary construction, the assembly method described above cannot be used for this embodiment. In this embodiment therefore, in order to place the dividers 18' into the slots 16' in the assembly of the apparatus 10', the anchor portion 32' of the dividers 18' (and possibly also the object support portion 34') are formed from a material which provides a small degree of resiliency, such as some types of molded plastics, so that the anchor portions 32' of the dividers 18' can be pressed (i.e., forced) downwardly along the inclined surfaces 16*a'*, 16*b'* into the slots 16'.

Optionally, as shown in FIG. 3B, one or both transverse ends of the anchor portion 32' may include a projection 44 which is engaged with a recess 46 in an inner wall defining the cavity 14' to more securely retain the dividers 18' in the slots 16'. One or both of the transverse ends of the anchor portion could also be provided with a recess while the inner wall of the cavity 14' is provided with a complementary projection.

Assembly of the apparatus 10' would therefore entail simply pressing each divider 18' into a respective slot 16', and so that the projection on the divider 18's enters into the recess 46 in the inner wall of the base 12' defining the cavity 14' if present.

Figure 3C:
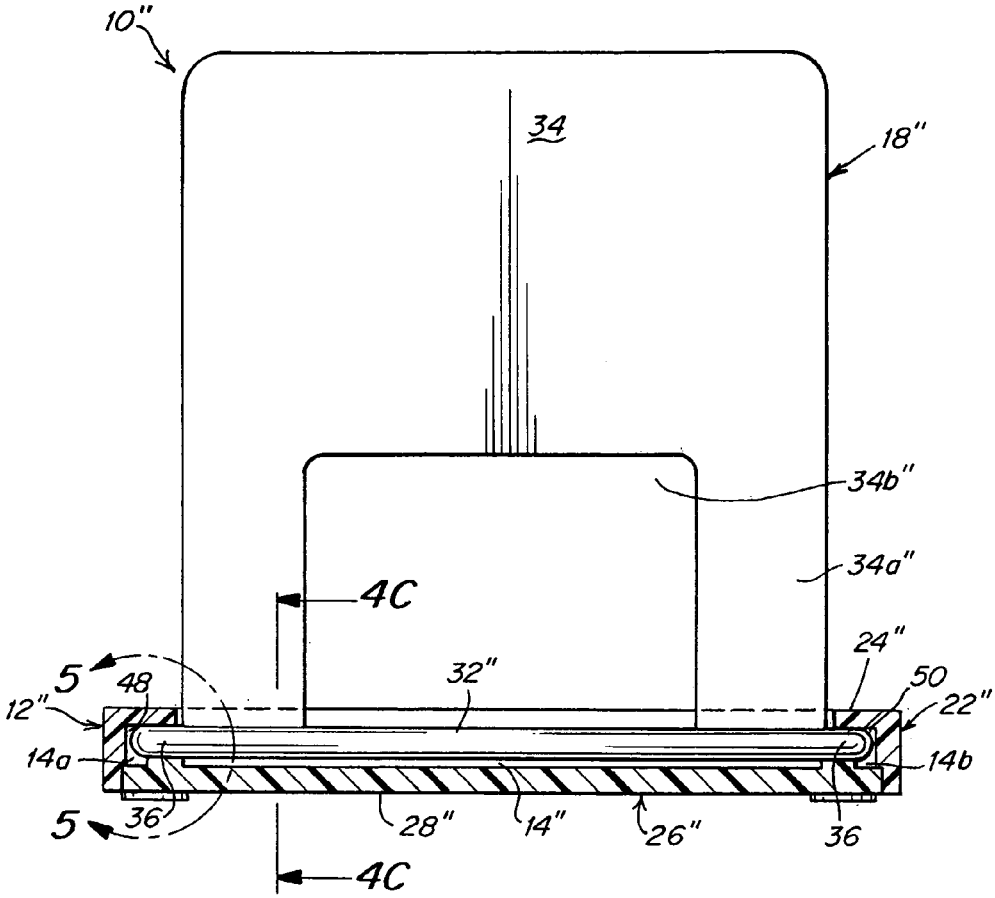
FIG. 3C is a cross-sectional view taken along the line 3—3 in FIG. 2 of still another embodiment of a multi-section retaining/sorting/browsing apparatus in accordance with the invention.
Figure 4C:
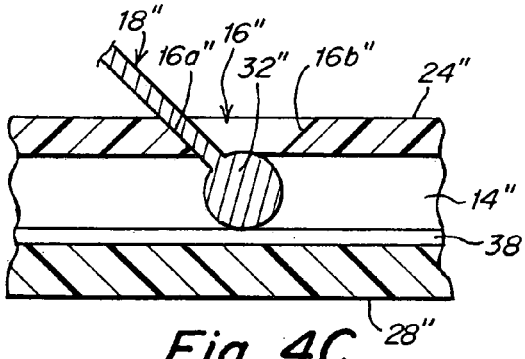
FIG. 4C is a cross-sectional view taken along the line 4C—4C in FIG. 3C.
Figure 5:
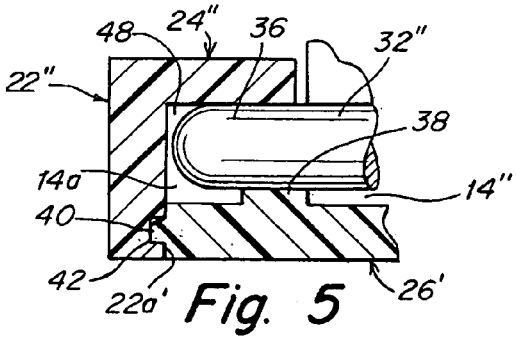
FIG. 5 is an enlarged view of the area encircled by arrows 5—5 in FIG. 3C.
Figure 6:
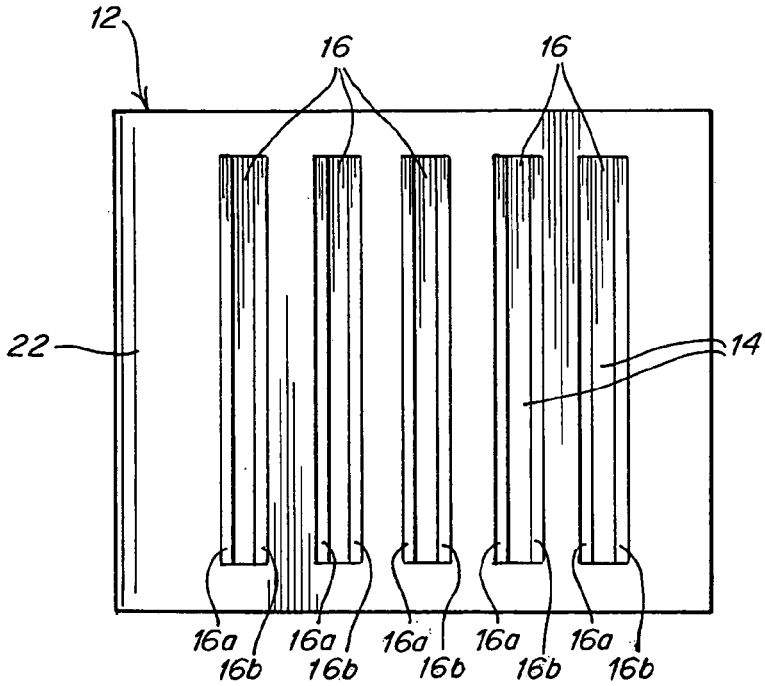
FIG. 6 is a top view of a base of the multi-section retaining/sorting/browsing apparatus in accordance with the invention shown in FIG. 1.

Referring now to FIGS. 3C, 4C and 5, another embodiment of the multi-section retaining/sorting/browsing apparatus in accordance with the invention (designated 10") includes a base 12" defining a single cavity 14" and a plurality of slots 16" all communicating with the cavity 14". The base 12" is comprised of an upper member 22" and a lower member 26". The apparatus 10" may have the same features of the embodiment described in FIGS. 3A and 4A unless otherwise noted or inconsistent with the following description and the same elements are now followed by the notation (").

Retention of the dividers 18" in connection with the base 12" is provided by constructing the anchor portion 32" of the dividers 18" to have a larger transverse length than the transverse length of the slots 16", and specifically, to extend beyond each transverse end of the slots 16". Thus, the slots 16" are formed in the top wall 24" of the upper member 22" so that each slot 16" has a first transverse end 48 spaced inward from an adjacent end 14*a* of the cavity 14" and a second transverse end 50 spaced inward from an adjacent end 14*b* of the cavity 14" (see FIGS. 3C and 5). An overhanging portion of the top wall 24" is thus arranged above the cavity 14" alongside each of the slots 16". The anchor portion 32" of each divider 18" includes a projection 36 at each transverse end which is situated below the overhanging portion of the top wall 24".

The projections 36 are secured in the base 12" between the top wall 24" and the bottom wall 28" to enable rotation of the anchor portion 32" and thus the divider 18". To this end, the projections 36 may be supported on raised shoulders 38 of the bottom wall 28" so that the projections 36 are positioned between the shoulders 38 and the overhanging portion of the top wall 24" defined by the upper member 22" (see FIGS. 3C and 4C). The anchor portion 32" of each divider 18" may be substantially cylindrical with the projections 36 being rounded in the form of bullets.

To assemble the apparatus 10", the upper and lower members 22", 26" and dividers 18" are first constructed and the dividers 18" are inserted through the slots 16" by inserting the object support portions 34" of the dividers 18" through the slots 16" until the anchor portions 32" come into contact with the lower surface of the top wall 24" of the upper member 22". Then, the lower member 26" is inserted into the opening in the upper member 22" and attached to the upper member 22". The apparatus is thus ready for use for retaining objects, for enabling sorting of objects such as papers and documents, and for enabling browsing of objects such as file folders. The dividers 18" may be pressed down into slots 16" as described above with reference to FIGS. 3B and 4B when the materials have sufficient resiliency.

Figure 7:
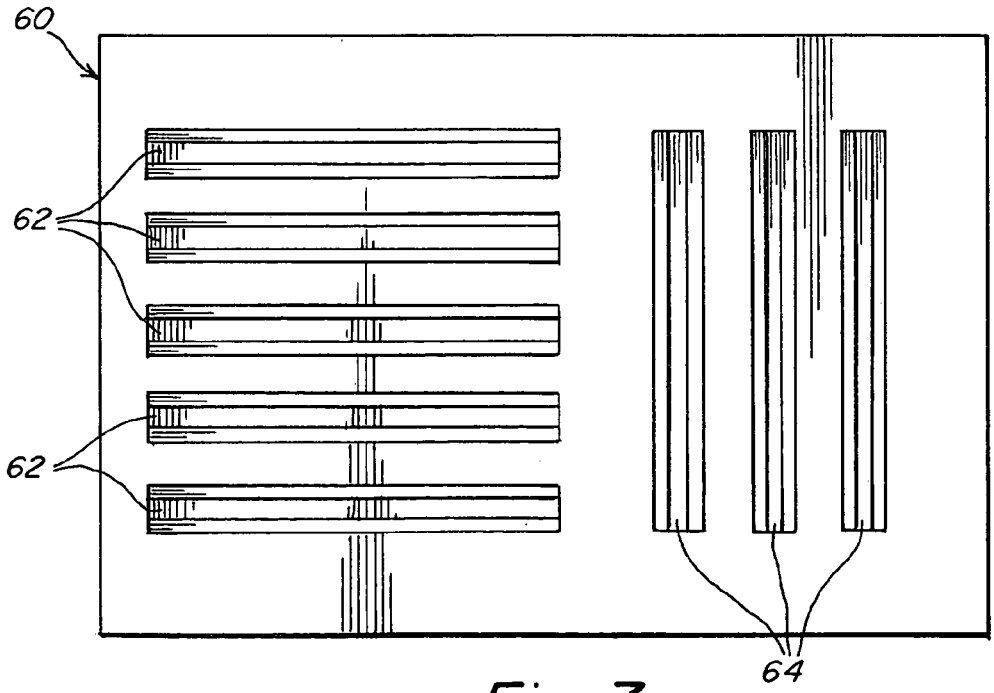
FIG. 7 is a top view of another base for a multi-section retaining/sorting/browsing apparatus in accordance with the invention.

As shown in FIG. 7, a multi-section retaining/sorting/browsing apparatus in accordance with the invention can include a base 60 which has two sets of parallel slots 62, 64 oriented in different directions. The base 60 can be designed in any of the ways described above to accommodate any of the particular dividers described above. For example, the base 60 can be fabricated from two components and each slot 62, 64 can be provided with a smaller width than the width of the divider to received in the slot. The same features of the embodiments shown in FIGS. 1–6 can be applied to this embodiment as well, to the extent possible.

Figure 8:
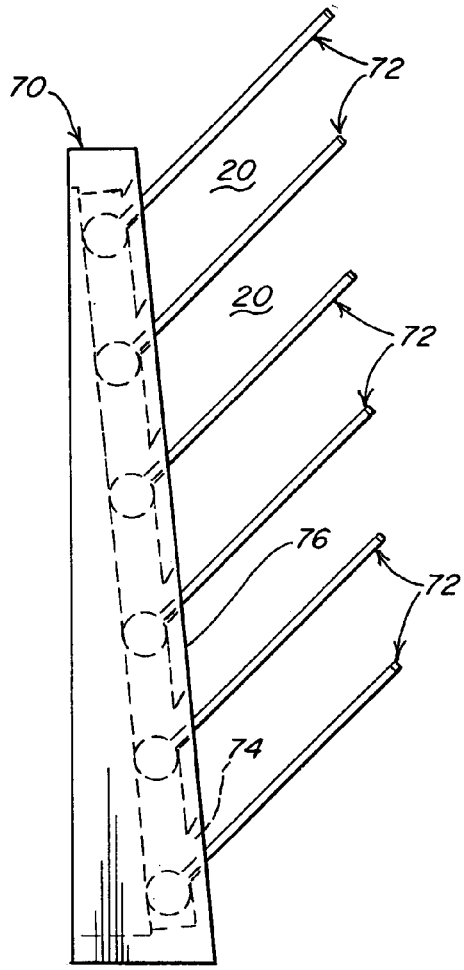
FIG. 8 is a side view of another base for a multi-section retaining/sorting/browsing apparatus in accordance with the invention.
Figure 8A:
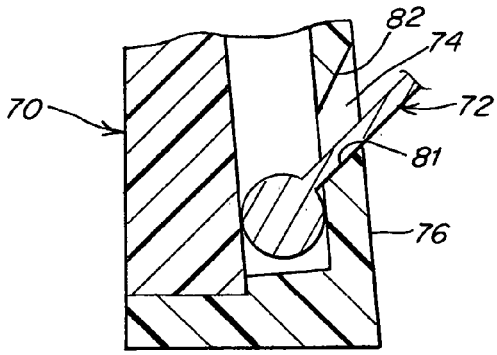
FIG. 8A is an enlarged partial sectional view of the lower portion of the embodiment of FIG. 8.

Although in the embodiments described above, the slots are formed in a top wall of the base, other forms and shapes of the base can be constructed in which the slots are formed in other walls of the base. For example, FIG. 8 shows a wall-mountable embodiment including a base 70 mountable to a wall, via appropriate mounting means such as nails, screws, adhesive and the like, and dividers 72 wherein slots 74 are formed in an angled side wall 76 of the base 70. The angled surfaces 81, 82 defining the slots 74 are formed to limit the angular orientation of the dividers 72 and therefore to enable objects to be retained in object-retaining sections 20 formed between adjacent pairs of the dividers 27. For example, as shown in FIG. 8A, lower angled surface 81 defines the lower limit to which divider 72 can travel. The lower angled surface 81 may be around 45° from the horizontal, and the upper angled surface 82 may be around 60° or more from the horizontal, Other angles, of course, could be used. Other angular orientations can be used, as desired.

The various bases and dividers described above can each be made of various materials, such as aluminum, wood and plastic, so that various combinations of materials are possible.

It should be clear that various modifications and alterations can be made within the scope of the present invention. Also, various features of one embodiment can be combined with features of other embodiments, consistent with proper operation thereof, within the scope of the present invention. All of the embodiments can be assembled by pressing the dividers down through the slots and into the cavity(ies), when the materials have sufficient resiliency or elasticity.

I claim:

1. A multi-section retaining/sorting/browsing apparatus, comprising:

a base defining at least one cavity and including a first plurality of parallel slots opening to said at least one cavity; and a plurality of dividers arranged in connection with said base to define an object-retaining section between adjacent ones of said dividers, each of said dividers having an anchor portion arranged in said at least one cavity and an object support portion coupled to said anchor portion and extending through a respective one of said slots to provide a support for retaining objects, said anchor portion of each of said dividers having a width larger than a width of the respective one of said slots to thereby retain said anchor portion in connection with said base, said anchor portion being rotatable in said at least one cavity to enable said divider to be flipped forward and backward in a longitudinal direction.

2. The apparatus of claim 1, wherein said at least one cavity comprises a plurality of independent cavities, each of said slots opening to a respective one of said cavities.

3. The apparatus of claim 1, wherein said anchor portions are substantially cylindrical and the width of said anchor portion is a diameter of said anchor portion.

4. The apparatus of claim 1, wherein said anchor portion of each of said dividers is formed from a resilient material which enables said anchor portion to be pressed through said slots into said at least one cavity.

5. The apparatus of claim 1, wherein said anchor portion of each of said dividers has substantially the same length as a transverse length of said at least one cavity.

6. The apparatus of claim 1, wherein at least one end of said anchor portion includes a projection engageable with a recess in an inner wall of said at least one cavity.

7. The apparatus of claim 1, wherein said anchor portion of each of said dividers has a length in a transverse direction larger than a length of the respective one of said slots in the transverse direction and extends at each transverse end beyond a respective transverse end of said slot.

8. The apparatus of claim 7, wherein each of said slots has a first transverse end spaced inward from an adjacent end of said at least one cavity and a second transverse end spaced inward from an adjacent end of said at least one cavity such that a portion of said base overhangs said at least one cavity, said anchor portion including a projection at each transverse end arranged below the overhanging portion of said base.

9. The apparatus of claim 1, wherein each of said dividers further includes a projection arranged at each transverse end of said anchor portion of each of said dividers to provide said anchor portion with a larger transverse length than a length of said slot.

10. The apparatus of claim 1, wherein said base includes a top wall and a bottom wall defining said at least one cavity, said slots being defined in said top wall, said anchor portion being retained between said bottom wall and said top wall.

11. The apparatus of claim 10, wherein each of said slots is defined by angled surfaces of said top wall arranged to provide a smaller opening in a lower surface of said top wall than in an upper surface of said top wall for each of said slots, said angled surfaces limiting flipping of said dividers.

12. The apparatus of claim 10, wherein said base comprises a first member defining said top wall and a second member defining said bottom wall.

13. The apparatus of claim 12, wherein said second member includes opposed shoulders for supporting said anchor portions of said dividers.

14. The apparatus of claim 12, wherein said first member has a lower surface defining an opening, said second member being arranged in said opening and fixed to said first member to thereby define said at least one cavity.

15. The apparatus of claim 1, further comprising a second plurality of slots oriented in a different direction than said first plurality of slots.

16. The apparatus of claim 1, wherein said at least one cavity consists of a single cavity.

17. The apparatus of claim 1, wherein said base is arranged to be mounted to a vertical surface.

18. A multi-section retaining/sorting/browsing apparatus, comprising:

a base comprising a first member defining a top wall of said base and a second member defining a bottom wall of said base and separable from said first member, said top and bottom walls defining a single cavity therebetween, said top wall including a first plurality of parallel slots all opening to said cavity; and a plurality of dividers arranged in connection with said base to define an object-retaining section between adjacent ones of said dividers, each of said dividers having an anchor portion arranged in said cavity and an object support portion coupled to said anchor portion and extending through a respective one of said slots to provide a support for retaining objects, said anchor portion being retained between said bottom wall and said top wall of said base and being rotatable in said cavity to enable said divider to be flipped forward and backward in a longitudinal direction, said anchor portion of each of said dividers having a length in a transverse direction larger than a length of the respective one of said slots in the transverse direction and extending at each transverse end beyond a respective transverse end of said slot.

19. The apparatus of claim 18, wherein said second member of said base includes opposed shoulders for supporting said anchor portions of said dividers.

20. The apparatus of claim 18, wherein said anchor portions are substantially cylindrical and have a width larger than a width of the respective one of said slots.

21. The apparatus of claim 18, wherein each of said slots has a first transverse end spaced inward from an adjacent end of said cavity and a second transverse end spaced inward from an adjacent end of said cavity such that a portion of said base overhangs said cavity, said anchor portion including a projection at each transverse end arranged below the overhanging portion of said base.

22. The apparatus of claim 18, wherein each of said dividers further includes a projection arranged at each transverse end of said anchor portion of each of said dividers.

23. The apparatus of claim 18, further comprising a second plurality of slots oriented in a different direction than said first plurality of slots.

* * * * *